US005973453A

United States Patent [19]

Van Vliet et al.

[11] Patent Number: 5,973,453

[45] Date of Patent: Oct. 26, 1999

[54] CERAMIC METAL HALIDE DISCHARGE LAMP WITH NAI/CEI$_3$ FILLING

[75] Inventors: Johannes A. J. M. Van Vliet; Johannes J. F. Geijtenbeek, both of Eindhoven, Netherlands

[73] Assignee: U.S. Philips Corporation, New York, N.Y.

[21] Appl. No.: 08/982,563

[22] Filed: Dec. 2, 1997

[30] Foreign Application Priority Data

Dec. 4, 1996 [EP] European Pat. Off. ..... 96203434

[51] Int. Cl.$^6$ ..... H01J 17/00; H01J 61/00

[52] U.S. Cl. ..... 313/623; 313/606; 313/620; 313/634

[58] Field of Search ..... 313/623, 624, 313/625, 626, 631, 634, 642, 331, 332, 622, 620, 639, 640, 570, 573, 638

[56] References Cited

U.S. PATENT DOCUMENTS

| | | |
|---|---|---|
| 3,786,297 | 1/1974 | Zollweg et al. . |
| 4,972,120 | 11/1990 | Witting . |

FOREIGN PATENT DOCUMENTS

| | | | |
|---|---|---|---|
| 0215524A1 | 3/1987 | European Pat. Off. . | |
| 0443675 | 8/1991 | European Pat. Off. | H01J 61/82 |
| 0645799 | 3/1995 | European Pat. Off. | H01J 61/26 |
| 56-091368 | 7/1981 | Japan | H01J 61/16 |
| 2132011 | 6/1984 | United Kingdom | H01J 61/02 |

*Primary Examiner*—Sandra O'Shea
*Assistant Examiner*—Joseph Williams
*Attorney, Agent, or Firm*—F. Brice Faller

[57] ABSTRACT

Metal halide lamp with ceramic discharge vessel having electrodes with spacing EA, internal diameter Di, and EA/Di>5. Ionizable filling comprises NaI and CeI$_3$, and a coldest spot temperature of 1100–1500 K is achieved.

5 Claims, 1 Drawing Sheet

CERAMIC METAL HALIDE DISCHARGE LAMP WITH NAI/CEI$_3$ FILLING

BACKGROUND OF THE INVENTION

The invention relates to a metal halide lamp provided with a discharge vessel with a ceramic wall which encloses a discharge space in which an ionizable filling is present, two electrodes having tips with a mutual distance EA being arranged in said discharge space, the latter having an internal diameter Di at least over the distance EA.

A lamp of the kind mentioned in the opening paragraph is known from EP-A-0 215 524. The known lamp, in which a high luminous efficacy goes hand in hand with excellent color properties (inter alia a general color rendering index $R_a \geqq 80$ and a color temperature Tc of between 2600 and 4000 K), is highly suitable as a light source for inter alia interior lighting. This lamp construction is based on the recognition that a good color rendering is possible when sodium halide is used as a filling ingredient of a lamp and a strong widening and inversion of the Na emission in the Na-D lines takes place during lamp operation. This requires a high coldest-spot temperature $T_{kp}$ in the discharge vessel of, for example, 1170 K (900° C.). Inversion and widening of the Na-D lines imply that they take the shape of an emission band in the spectrum with two maxima at a mutual distance of $\Delta\lambda$. The requirement that $T_{kp}$ should have a high value excludes under practical conditions the use of quartz or quartz glass for the discharge vessel wall and renders the use of a ceramic material for the discharge vessel wall necessary.

The term "ceramic wall" in the present description and claims is understood to cover a wall of metal oxide such as, for example, sapphire or densely sintered polycrystalline $Al_2O_3$ as well as metal nitride, for example AlN.

The known lamp combines a good color rendering with a comparatively wide range of the color temperature. The filling of the discharge vessel comprises at least Na halide and Tl halide. In addition, the discharge vessel preferably contains at least one element from the group formed by Sc, La, and the lanthanides Dy, Tm, Ho, and Er. The known lamp has a comparatively short discharge vessel for which it is true that $0.9 \leqq EA/Di \leqq 2.2$, and a high wall load which is more than 50 W/cm$^2$ for practical lamps. The wall load is defined here as the quotient of the lamp power and the outer surface of that portion of the discharge vessel wall which is situated between the electrode tips.

It is a disadvantage of the known lamp that it has a comparatively limited luminous efficacy for general lighting purposes.

U.S. Pat. No. 4,972,120 discloses a lamp which radiates white light with reasonable color properties (3000 $K \leqq T_c \leqq 4000$ K; $R_a$ approximately 50–60) and which has a comparatively high luminous efficacy. This lamp, however, requires a solenoidal electric field for energizing the discharge, for which purpose the lamp is provided with an external coil which is wound largely around the discharge vessel. The coil is to be operated at a very high frequency of more than 1 MHz. Although the light radiated by the lamp is in itself quite useful for general lighting purposes, the exceptional construction of the lamp and the specific electric supply equipment required for it render the use of this lamp for general lighting purposes not very practical.

U.S. Pat. No. 3,786,297 describes discharge lamps having very high luminous efficacies and provided with electrodes. The filling of the discharge vessel for this purpose comprises at least Cs halide and a comparatively large quantity of Hg (between approximately 3 mg/cm$^3$ and 20 mg/cm$^3$) which has a pressure of more than 3 at during lamp operation. Although Cs has a low ionization voltage, radiation from Cs lies for a considerable portion outside the visible part of the spectrum. It was found that the light radiated by the lamp has color properties such that it is less suitable for use in general lighting. The use of a large dose of Hg is undesirable for environmental reasons.

An important disadvantage of the metal halide lamps fitted with electrodes and having a high luminous efficacy is the major risk of spiraling instabilities occurring in the discharge, and of additive segregation in the filling of the discharge vessel.

SUMMARY OF THE INVENTION

The invention has for its object to provide a measure for obtaining a metal halide lamp with a high luminescent efficacy which is suitable for general lighting purposes.

According to the invention, the ionizable filling comprises NaI and CeI$_3$, and in that the relation EA/Di>5 is complied with.

The lamp according to the invention has the advantage that a high luminous efficacy can be realized in combination with good color properties ($R_a \geqq 40$, color temperature $T_c$: $2800 \leqq T_c \leqq 6000$ K), which render the lamp very suitable for use as a general lighting source. The discharge arc is hemmed in by the wall of the discharge vessel owing to the comparatively small diameter in relation to the electrode spacing, and thus to the discharge arc length, whereby it is achieved that the discharge arc is straight. It is surprisingly found that the wall of the discharge vessel is subject to a heating which is so homogeneous that the risk of fracture of the discharge vessel wall owing to thermal stresses is very small. The occurrence of spiraling instabilities and segregation is also found to be strongly counteracted thereby.

The fact that the discharge arc is hemmed in means that the good heat conductivity of the ceramic material of the discharge vessel wall is advantageously used as a means for reducing thermal stresses in the discharge vessel wall. This is furthermore favorably affected by a choice of preferably at most 30 W/cm$^2$ for the wall load.

A further improvement in controlling the wall temperature and thermal stresses in the discharge vessel wall can be achieved through a suitable choice of the wall thickness. The good heat conduction properties of the ceramic wall are utilized to further advantage when the ceramic wall has a thickness of at least 1 mm. An increase in the wall thickness here results not only in an increase in the heat radiation by the discharge vessel wall, but it promotes most of all a better heat transport from the portion of the wall lying between the electrodes to the comparatively cool ends of the discharge vessel. It is achieved thereby that the temperature difference occurring over the wall of the discharge vessel remains limited to 200–250 K. An increase in the wall thickness also leads to a reduction of the wall load.

An increase in the ratio EA/Di through an increase in EA also provides a reduction of the wall load. Increasing radiation losses at the discharge vessel wall will occur then, however, and accordingly increasing heat losses of the discharge vessel during lamp operation. This will lead to a drop in $T_{kp}$, all other circumstances remaining the same.

It is necessary for obtaining a high luminous efficacy and good color properties that sufficiently high concentrations of Na and Ce should be present, which manifests itself inter alia in the value of $\Delta\lambda$. The value of $\Delta\lambda$ is connected inter alia with the molar ratio NaI:CeI$_3$ and the level of $T_{kp}$. It was found to be sufficient for the lamp according to the invention when $\Delta\lambda$ has a comparatively low value, preferably in the range from 2 nm to 6 nm. It was experimentally found that a desired value of $\Delta\lambda$ can already be realized given a level of $T_{kp}$ of 1100 K. The value of 1100 K is accordingly the minimum value which $T_{kp}$ is required to assume during lamp operation. Preferably, 1200 K or more is realized for $T_{kp}$.

An advantage of the above range of $\Delta\lambda$ is that a limited range for $T_{kp}$ can suffice. There is accordingly no necessity of using very high $T_{kp}$ values, which is favorable for achieving a long lamp life. It should obviously be ensured in all cases that $T_{kp}$ is lower than the maximum temperature which the ceramic wall material is capable of withstanding or longer periods.

Further experiments have shown that it is desirable to adopt 1500 K as a maximum value for $T_{kp}$. The temperatures and pressures prevailing in the discharge vessel with $T_{kp}$>1500 K become such that chemical corrosion processes of the discharge vessel wall give rise to unacceptable reductions in lamp life. Preferably, $T_{kp}$ is at most 1400 K when densely sintered $Al_2O_3$ is used for the discharge vessel wall.

According to the invention, the molar ratio NaI:$CeI_3$ lies between 3 and 25. It is found for a ratio below 3 that on the one hand the luminous efficacy becomes unacceptably low, and on the other hand the light radiated by the lamp contains an excessive amount of green. A color correction of the light, for example through the addition of salts to the ionizable filling of the discharge vessel, is possible only to the detriment of the luminous efficacy then. With a ratio higher than 25, the influence of the Ce on the color properties of the lamp is so small that these color properties show a strong resemblance to those of the known high-pressure sodium lamps.

If a lamp is to be suitable for general lighting purposes, a luminous efficacy is in fact required comparable to what is usual for this application in widely used high-pressure sodium lamps. The luminous efficacy of these high-pressure sodium lamps generally lies in the range from 100 lm/W to 130 Im/W. It is a disadvantage of these existing high-pressure sodium lamps that the radiated light is yellow instead of white and that the value of the general color rendering index $R_a$ is approximately 20. An acceptable $R_a$ value, however, is at least 40 for general lighting. Preferably, the $R_a$ value is at least 45, and it is particularly favorable when the value lies in the range from 50 to 70. It is noted for comparison that high-pressure mercury and metal halide lamps used in practice for general lighting have luminous efficacies of approximately 50 lm/W and up to a maximum of 90 lm/W, respectively, and $R_a$ values which lie between 50 and 90.

A rare gas is usually added to the ionizable filling of the discharge vessel for lamp ignition. It is possible to influence the photometric properties of the lamp through the choice of the filling pressure of the rare gas. In addition, a metal may be added, for example Hg, for realizing a desired lamp voltage. Zn is also suitable for this. Zn is also suitable for realizing a comparatively high $T_c$ value. The Zn may be added in the form of a metal. It is alternatively possible for the Zn to be added in the form of a salt, for example $ZnJ_2$, to the filling.

The above and further aspects of the lamp according to the invention will e explained in more detail with reference to a drawing (not true to scale).

DETAILED DESCRIPTION OF THE PREFERRED EMBODIMENTS

Figure 1:
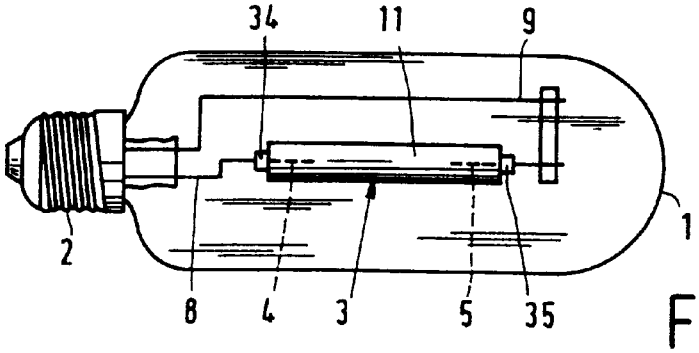
FIG. 1 diagrammatically shows a lamp according to the invention.
Figure 2:
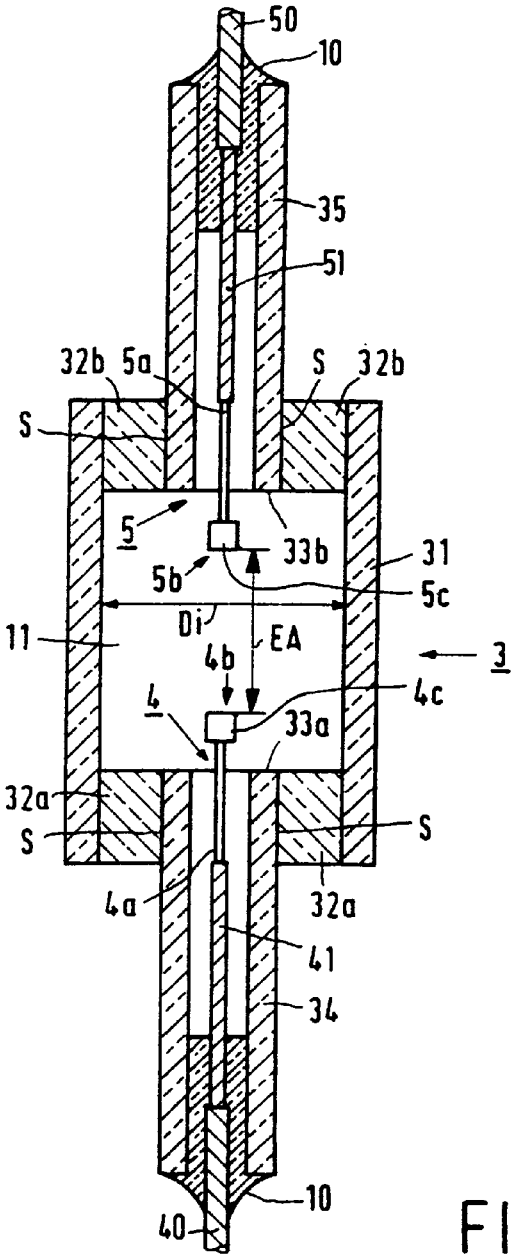
FIG. 2 shows the discharge vessel of the lamp of FIG. 1 in detail.

FIG. 1 shows a metal halide lamp provided with a discharge vessel 3 having a ceramic wall which encloses a discharge space 11 containing an ionizable filling. Two electrodes 4, 5 whose tips 4*b,* 5*b* are at a mutual distance EA are arranged in the discharge space, and the discharge vessel has an internal diameter Di at least over the distance EA. The discharge vessel is closed at one side by means of a ceramic projecting plug 34, 35 which encloses a current lead-through conductor (FIG. 2: 40, 41, 50, 51) to an electrode 4, 5 positioned in the discharge vessel with a narrow intervening space and is connected to this conductor in a gastight manner by means of a melting-ceramic joint (FIG. 2: 10) at an end remote from the discharge space. The discharge vessel is surrounded by an outer bulb 1 which is provided with a lamp cap 2 at one end. A discharge will extend between the electrodes 4, 5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not true to scale), has a ceramic wall and is formed from a cylindrical part with an internal diameter Di which is bounded at either end by a respective end wall portion 32*a,* 32*b,* each end wall portion 32*a,* 32*b* forming an end surface 33*a,* 33*b* of the discharge space. The end wall portions each have an opening in which a ceramic projecting plug 34, 35 is fastened in a gastight manner in the end wall portion 32*a,* 32*b* by means of a sintered joint S. The ceramic projecting plugs 34, 35 each narrowly enclose a current lead-through conductor 40, 41, 50, 51 of a relevant electrode 4, 5 having a tip 4*b,* 5*b*. The current lead-through conductor is connected to the ceramic projecting plug 34, 35 in a gastight manner by means of a melting-ceramic joint 10 at the side remote from the discharge space.

The electrode tips 4*b,* 5*b* are arranged at a mutual distance EA. The current lead-through conductors each comprise a halide-resistant portion 41, 51, for example in the form of a Mo—$Al_2O_3$ cermet and a portion 40, 50 which is fastened to a respective end plug 34, 35 in a gastight manner by means of the melting-ceramic joint 10. The melting-ceramic joint extends over some distance, for example approximately 1 mm, over the Mo cermet 40, 41. It is possible for the parts 41, 51 to be formed in an alternative manner instead of from a Mo—$Al_2O_3$ cermet. Other possible constructions are known, for example, from EP-0 587 238 (U.S. Pat. No. 5,424,609). A particularly suitable construction was found to be a halide-resistant coil applied around a pin of the same material. Mo is very suitable for use as a highly halide-resistant material. The parts 40, 50 are made from a metal whose coefficient of expansion corresponds very well to that of the end plugs. Nb, for example, is for this purpose a highly suitable material. The parts 40, 50 are connected to the current conductors 8, 9 in a manner not shown in any detail. The lead-through construction described renders it possible to operate the lamp in any burning position as desired.

Each of the electrodes 4, 5 comprises an electrode rod 4*a,* 5*a* which is provided with a coil 4*c,* 5*c* near the tip 4*b,* 5*b*. The projecting ceramic plugs are fastened in the end wall portions 32*a* and 32*b* in a gastight manner by means of a sintered joint S. The electrode tips then lie between the end surfaces 33*a,* 33*b* formed by the end wall portions. In an alternative embodiment of a lamp according to the invention, the projecting ceramic plugs 34, 35 are recessed behind the end wall portions 32*a,* 32*b*. In that case the electrode tips lie substantially in the end surfaces 33*a,* 33*b* defined by the end wall portions.

In a practical realization of a lamp according to the invention as shown in the drawing, the rated lamp power is 150 W. The lamp, which is suitable for being operated in an existing installation for operating a high-pressure sodium lamp (retrofit lamp) has a lamp voltage of 91 V. The ionizable filling of the discharge vessel comprises 0.7 mg Hg (<1.6 mg/cm$^3$) and 8 mg iodide salts of Na and Ce in a molar ratio of 7:1. The Hg serves to ensure that the lamp voltage will be between 80 V and 100 V, which is necessary for the retrofit requirement. In addition, the filling comprises Xe with a filling pressure of 250 mbar as an ignition gas.

The electrode tip interspacing EA is 32 mm, the internal diameter Di 4 mm, so that the ratio EA/Di=8. The wall thickness of the discharge vessel is 1.4 mm. The lamp accordingly has a wall load of 21.9 W/cm$^2$.

The lamp has a luminous efficacy of 130 lm/W in the operational state, which has dropped to 126 lm/W after an operational life of 2000 hours. The light radiated by the lamp has values for $R_a$ and $T_c$ of 58 and 3900 K, respectively. The light radiated by the lamp has a color point (x,y) with values (0.395, 0.416), which lies outside the blackbody line by less than (0.05, 0.05). The blackbody line is formed by the set of color points of a black or Planckian radiator. Light having a color point which deviates as little as above from the blackbody line is regarded as white light for general lighting purposes. The coldest-spot temperature $T_{kp}$ is 1200 K here and the value of $\Delta\lambda$ is 3.3 nm. 250 mbar Ar was used as the rare gas in a comparable lamp. This resulted in a lamp with comparable photometric properties.

It is noted for comparison that a high-pressure sodium lamp (make Philips, type SON PLUS) of the same power rating has a luminous efficacy of 110 lm/W and radiates yellow light with $T_c$=2000 K and $R_a$=21. A high-pressure mercury discharge lamp (make Philips, type HPL Comfort) does radiate light with color properties comparable to those of the lamp according to the invention, but here the luminous efficacy is no more than 50 to 60 lm/W. In a modification, the only change was that the molar ratio between the NaI and $CeI_3$ was changed to 25:1, which resulted in a luminous efficacy of 124 lm/W at a lamp voltage of 80 V, a color temperature of 2820 K and a color rendering index of 41. $T_{kp}$ is 1200 K under these conditions, and the value of $\Delta\lambda$ is 4 nm. The color point coordinates are (0.459;0.423) the photometric properties of the light radiated by this lamp are only just acceptable for general lighting purposes.

In an alternative realization, the lamp is free from Hg. The lamp has an electrode spacing EA of 32 mm and an internal diameter Di of 4 mm. The filling of the discharge vessel comprises 8 mg NaI/$CeI_3$ in a molar ratio 7:1 and Xe. The wall load is 21.9 W/cm$^2$. In a first embodiment with an Xe filling pressure of 1250 mbar, the power consumed by the lamp is 150 W and the lamp voltage is 47 V for a $T_{kp}$ of 1220 K. $\Delta\lambda$ is 4.1 nm in this embodiment of the lamp, the luminous efficacy is 150 lm/W, the color temperature $T_c$ 3300 K, and the general color rendering index $R_a$ is 49. The color point coordinates (x;y) are (0.436;0.446). In a second embodiment of this lamp, the Xe filling pressure is 500 mbar. The lamp voltage in this second embodiment is 45 V, $\Delta\lambda$ is 3.8 nm, the luminous efficacy is 145 lm/W, $T_c$ is 3600 K, $R_a$ is 53, and (x;y) is (0.421;0.447).

In a further modification of the same geometry and with 1250 mbar Xe, the molar ratio NaI:$CeI_3$ was changed to 5:1. The lamp is operated with a power of 185 W. Under these conditions the $T_{kp}$ value is 1240 K for a $\Delta\lambda$ of 4.5 nm, and the lamp voltage is 53 V, the luminous efficacy is 177 lm/W, $T_c$ is 4232 K, $R_a$ is 61, and (x;y) is (0.394;0.457). The wall load in this case is 27.1 W/cm$^2$. The mercury-free lamps described are operated by means of a square-wave voltage generated by an electronic ballast circuit.

Lamps according to the invention with a modified geometry were manufactured with a power rating of 150 W, an electrode spacing of 66 mm, an internal diameter of 2.6 mm, and a Xe filling pressure of 1250 mbar. In a first embodiment thereof, the filling comprises 8 mg NaI and $CeI_3$ in a molar ratio of 7:1. This lamp has a lamp voltage of 119 V and a luminous efficacy of 125 lm/W. $T_{kp}$ is 1250 K and $\Delta\lambda$ is 3.1 nm. The values of $T_c$, $R_a$ and (x;y) are 3480 K, 45, and (0.426;0.445), respectively.

In a second embodiment, the molar ratio of the Na salt to the Ce salt is 3.1. The lamp voltage of the second embodiment is 130 V under these conditions, the luminous efficacy is 130 lm/W, $T_c$ is 4312 K, $R_a$ is 61, and (x;y) is (0.383;0.441) for a $T_{kp}$ of 1460 K. The value of $\Delta\lambda$is 2.4 nm. These two embodiments were also operated with a square-wave voltage.

In another experiment, four lamps with a power rating of 150 W and with Zn as an additive were manufactured. All lamps contain NaI and $CeI_3$ in a molar ratio of 7:1. The wall thickness of the discharge vessel is 1.4 mm in all cases. In the first lamp, the internal diameter is 2.6 mm and the electrode spacing 32 mm. The Zn is added in the form of 0.4 mg $ZnI_2$. The lamp voltage of this lamp is 95 V, the luminous efficacy is 134 lm/W, $T_c$ is 4400 K, $R_a$ is 63, and the color point coordinates (x;y) are (0.378;0.429). $T_{kp}$ was found to be 1370 K and $\Delta\lambda$ 3.9 nm.

In the second lamp, the electrode spacing was increased to 42 mm and the quantity of Zn salt was reduced to 0.2 mg. At an arc voltage of 110 V, $T_{kp}$ is 1350 K, $\Delta\lambda$ is 3.7 nm, the luminous efficacy is 138 lm/W, the $T_c$ is 4600 K, $R_a$ is 64, and the color point coordinates (x;y) are (0.368;0.436).

Compared with the first lamp, the internal diameter of the discharge vessel of the third lamp was increased to 40 mm. The Zn was added in metal form in this case in a quantity of 4 mg. This led to a reduction in $T_{kp}$ to 1250 K for a $\Delta\lambda$ of 3.3 nm. The lamp has a lamp voltage of 85 V. The luminous efficacy is 115 lm/W for a $T_c$ value of 4000 K, an $R_a$ value of 62, and color point coordinates (x;y) of (0.395;0.427).

In the fourth lamp, 2 mg metallic Zn is added in a discharge vessel which has an internal diameter increased to 40 mm compared with the second lamp. This results in a further drop of $T_{kp}$ to 1230 K and a $\Delta\lambda$of 3.2 nm. The lamp voltage is 89 V here, the luminous efficacy 111 lm/W, and the color temperature 3900 K. The $R_a$ value is found to be 59, and the color point coordinates (x;y) are (0.402;0.432).

We claim:

1. A metal halide lamp comprising a discharge vessel with a ceramic wall which encloses a discharge space in which an ionizable filling is present, two electrodes having tips with and mutual distance EA being arranged in said discharge space, the discharge space having an internal diameter Di at least over the distance EA, wherein the ionizable filling comnprises, NaI and $CeI_3$ and EA/Di>5.

2. A lamp as claimed in claim 1, wherein the discharge vessel of the lamp has a wall load value of ≦30 W/cm$^2$.

3. A lamp as claimed in claim 1, wherein the wall of the ceramic discharge vessel has a thickness of 1 mm at least over the distance EA.

4. A lamp as claimed in claim 1, wherein the NAI and $CeI_3$ are present in a molar ratio which lies in a range from 3 to 25.

5. A lamp as claimed in claim 1, wherein the a coldest-spot temperature $T_{kp}$ of at least 1100 K and at most 1500 K prevails.

* * * * *